US007383631B2

(12) United States Patent
Kao

(10) Patent No.: US 7,383,631 B2
(45) Date of Patent: Jun. 10, 2008

(54) METHOD OF FABRICATING ANTENNA CONNECTOR

(75) Inventor: Shin-Shun Kao, Jhonghe (TW)

(73) Assignee: T-Conn Precision Corp.

( * ) Notice: Subject to any disclaimer, the term of this patent is extended or adjusted under 35 U.S.C. 154(b) by 483 days.

(21) Appl. No.: 11/163,254

(22) Filed: Oct. 12, 2005

(65) Prior Publication Data

US 2008/0104834 A1 May 8, 2008

(51) Int. Cl.
*H01R 43/04* (2006.01)

(52) U.S. Cl. ..... 29/882; 29/868; 29/876; 29/881; 29/828; 29/867; 439/583; 439/863

(58) Field of Classification Search ..... 29/600–601, 29/882–884, 828, 863, 867; 174/71 R, 73.1, 174/75 R, 89, 101, 117 F, 208, 480, 541, 174/545; 343/586, 713–715, 859, 886, 906; 439/13, 581, 607, 863, 879; 340/572.1–572.8
See application file for complete search history.

(56) References Cited

U.S. PATENT DOCUMENTS 2,668,239 A * 2/1954 Jipp ..... 174/44
4,005,524 A * 2/1977 Schultz ..... 29/882
4,733,464 A * 3/1988 Gregorac ..... 29/867
5,380,223 A * 1/1995 Marsh et al. ..... 439/610
5,862,589 A * 1/1999 Chadbourne et al. ..... 29/882
6,043,782 A * 3/2000 Dishart et al. ..... 343/906
6,101,712 A * 8/2000 Wright ..... 29/863
7,314,386 B2 * 1/2008 Kao ..... 439/607

* cited by examiner

*Primary Examiner*—Minh Trinh
(74) *Attorney, Agent, or Firm*—Morris Lin; T-Conn Precision Corp.

(57) ABSTRACT

A method of fabricating an antenna connector is provided. The components of the antenna connector are mechanically assembled in an automatically operated workstation to effectively eliminate the labor/time consuming assembly process requiring assembly by hand as in the case of the prior art. The electrical connection between the coaxial cable and the terminal can be ensured and also the coaxial cable can be effectively secured to the housing so that the coaxial cable may not come loose. Thus, it is not only possible to effectively increase the production throughput, but also the reliability of the antenna connector may be effectively promoted.

4 Claims, 7 Drawing Sheets

METHOD OF FABRICATING ANTENNA CONNECTOR

FIELD OF THE INVENTION

The present invention generally relates to a method of fabricating method an antenna connector, and more particularly to a method of fabricating an antenna connector, wherein the assembly of components is implemented by machines and thereby promote production yield and as well as production throughput.

DESCRIPTION OF RELATED ART

In a conventional method of fabricating antenna connector, the assembly of the components is accomplished manually, wherein the terminals are assembled on an insulated housing by hand, and then a metal housing is covered on the insulated housing is covered by hand. Finally, a coaxial line is inserted through one end of metal housing by hand, and then the coaxial line is electrically connected to the terminals and secured again by hand.

However, because the size of the connector is small and therefore assembly by hand is not only time consuming but also the error rate is high, such as electrical connection of the coaxial cable to the terminals may not be secure enough or the coaxial cable may be properly secured to the housing and may come loose. Thus, both the production yield and production throughput are reduced. Therefore, the abovementioned method of fabricating the antenna connector is not practical.

SUMMARY OF THE INVENTION

The features and the advantages of the present invention will be more readily understood upon a thoughtful deliberation of the following detailed description of a preferred embodiment of the present invention with reference to the accompanying drawings.

Therefore, an object of the present invention is to provide a method of fabricating an antenna connector, wherein the assembly of the components of the antenna connector is accomplished by using automatically operated workstation in order to eliminate the manual assembly by human and thereby effectively reduced the error rates from occurring as in the case of the prior art described above and thereby promote the production yield and production throughput.

According to an aspect of the present invention, because the assembly of the components is accomplishes by mechanical means, therefore, the electrical connection of the coaxial cable with the terminals is effectively promoted and also the coaxial cable is effectively secured to the housing. Thus, the reliability of the antenna connector is effectively promoted.

In accordance with the abovementioned object of the present invention, a method of fabricating an antenna connector is provided. First, the metal plate is placed on a work station. The metal plate comprises a terminal, two wing boards located adjacent and on either side of the terminal and a clamping portion located below the terminal, wherein the clamping portion comprises a buckling portion. Next, an isolation member is provided. The isolation member comprises a sleeve located at a position corresponding to the terminal, two fixing portions located at positions corresponding to the two wing boards, and a long plate and a short plate extending from a distal end side portion of the sleeve. Next, the isolation member is placed over the metal plate such that the terminal is received within the sleeve of the isolation member and the two wing boards are connected to the two fixing portions of the isolation member respectively. Next, a coaxial cable is clamped to the clamping portion of the metal plate and electrically connected to the terminal. The terminal and the clamping portion, and the fixing portions are cut and separated from the metal plate and the isolation member respectively while the terminal is positioned within the sleeve of the isolation member. The long plate is bent by 180° to cover a backside of the terminal and the short plate is bent by 90° so that the terminal is insulated and secured within the sleeve and the resulting structure is cut and separated from the metal plate. Next, a housing comprising an aperture and clamping plates located at a bottom thereof is provided. Next, the sleeve together with the terminal and the coaxial cable electrically connected to the terminal are disposed within the housing such that the sleeve is received inside the aperture and the coaxial cable is disposed in between the clamping plates. Next, the clamping plates bent so as to secure the coaxial cable and the sleeve within the housing. Next, a back plate comprising an aperture corresponding to the buckling portion of the clamping portion is assembled to the above resulting structure such that the buckling portion of the clamping portion is buckled to the aperture of the back plate.

DETAILED DESCRIPTION OF THE INVENTION

The present invention provides a method of fabricating an antenna connector, wherein the assembly of the components of the antenna connector is accomplished by using an automatically operated workstation in order to eliminate the manual assembly by human and thereby effectively reduced the error rates from occurring as in the case of the prior art described above and thereby promote the production yield and production throughput.

Figure 1:
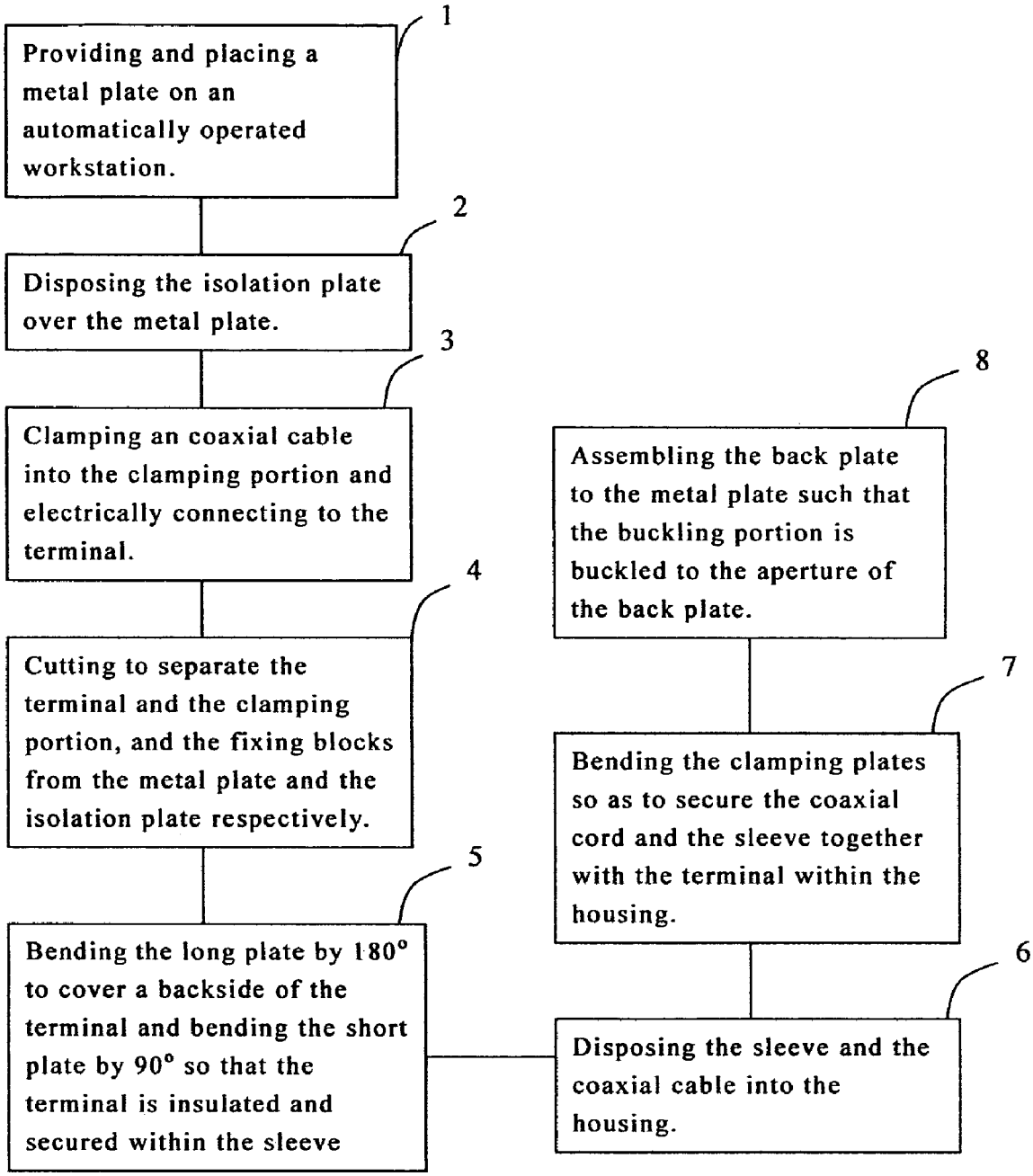
FIG. 1 shows a flowchart illustrating a method of fabricating an antenna connector according to an embodiment of the present invention.
Figure 2:
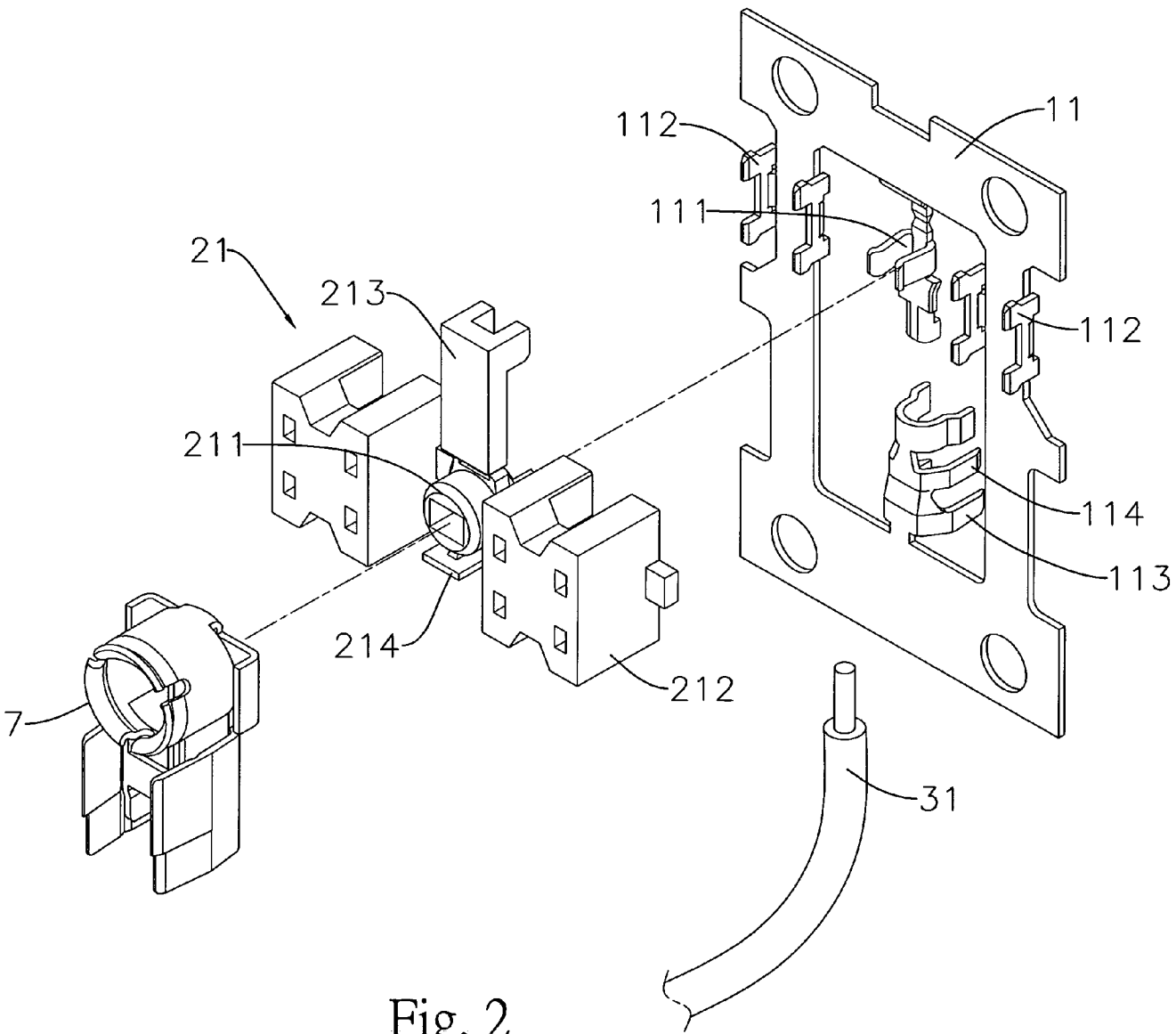
FIG. 2 shows an exploded view of various components used in the fabrication of an antenna connector according to an embodiment of the present invention.
Figure 3:
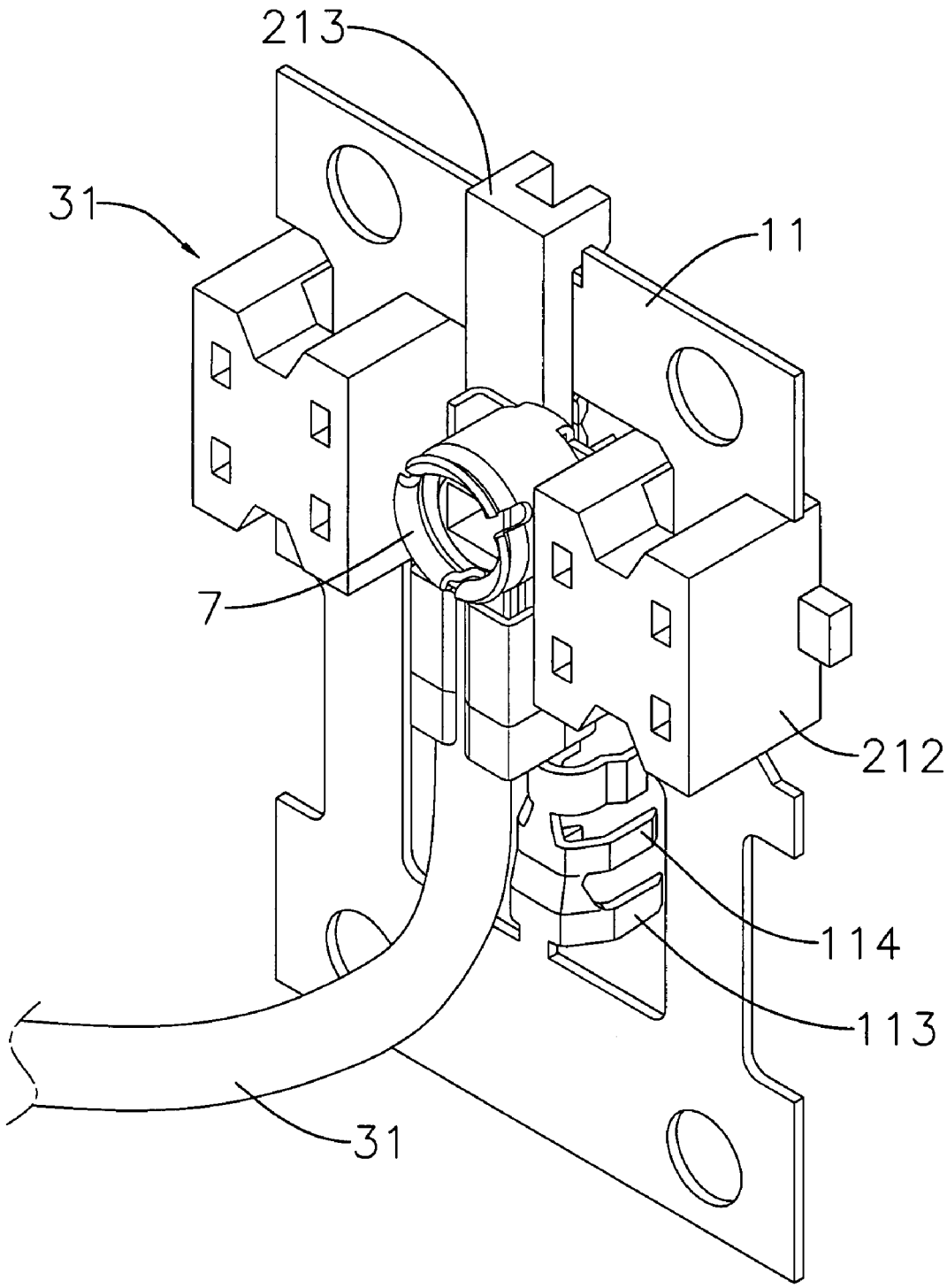
FIG. 3 shows a perspective view of an antenna connector according to an embodiment of the present invention.
Figure 4:
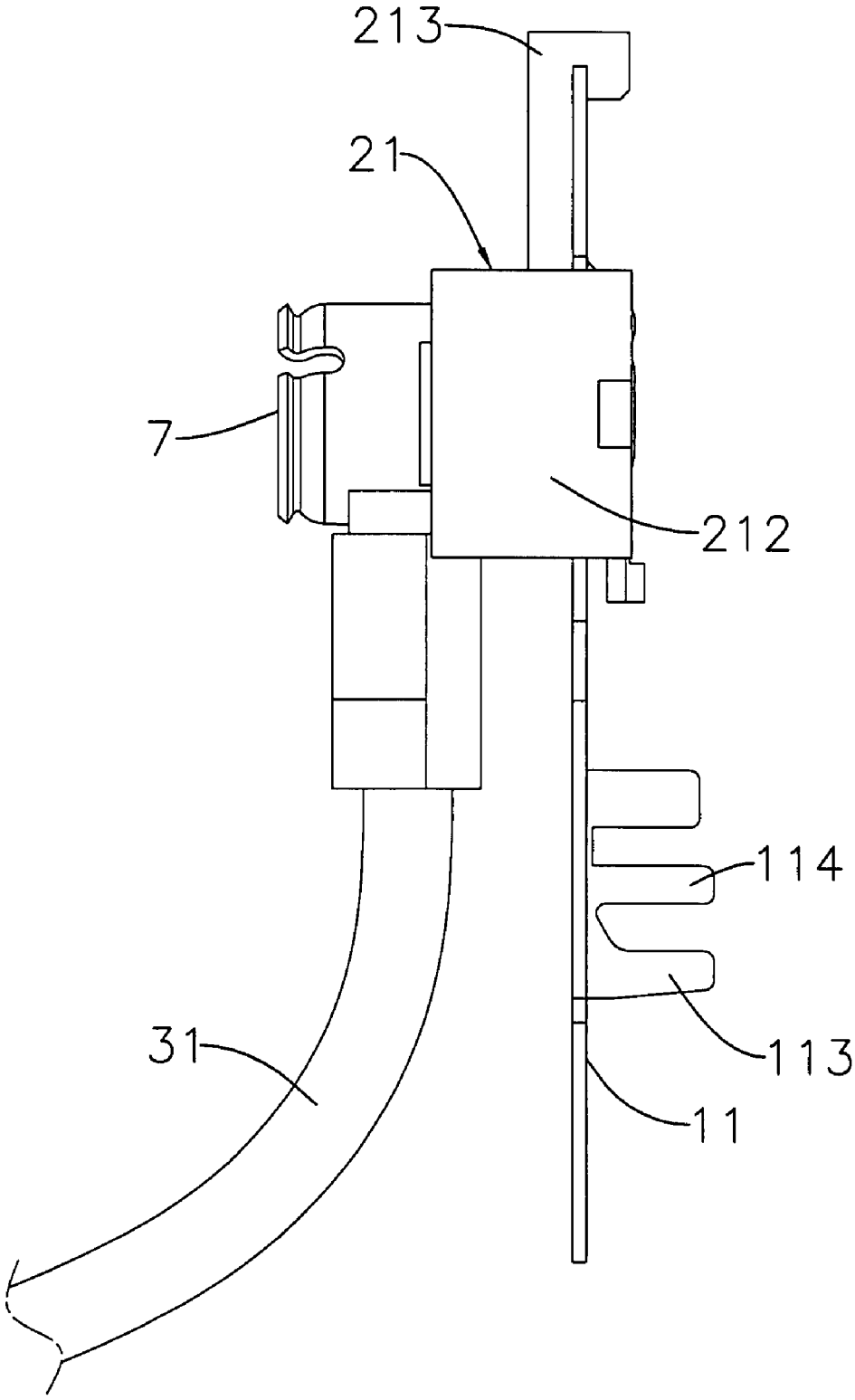
FIG. 4 shows a sectional side view of an antenna connector according to an embodiment of the present invention.

Hereinafter, the method of fabricating the antenna connector according to an embodiment of the present invention is described with reference to FIG. 1-3. Referring to FIG. 1-5, first, the metal plate 11 is placed on a work station. The metal plate comprises a terminal 111, two wing boards 112 and a clamping portion 113 located below the terminal 111, wherein the clamping portion 113 comprises a buckling portion 114. The two wing boards 112 are located adjacent and on either sides of the terminal 111. Next, an isolation member 21 is provided. The isolation member 21 comprises a sleeve 211 located at a position corresponding to the terminal 111, two fixing portions 212 located at positions corresponding to the two wing boards 112, and a long plate 213 and a short plate 214 extending from a distal end side portion of the sleeve 211. Next, the isolation member 21 is placed over the metal plate 11 such that the terminal 111 is received within the sleeve 211 of the isolation member 21 and the two wing boards 112 are connected to the two fixing portions 212 of the isolation member 21 respectively. Next, a coaxial cable 31 is clamped to the clamping portion 113 of the metal plate 11 and electrically connected to the terminal 111. The terminal 111 and the clamping portion 113, and the fixing portions 212 are cut and separated from the metal plate 11 and the isolation member 21 respectively while the terminal 111 is positioned within the sleeve 211 of the isolation member 21. The long plate 213 is bent by 180° to cover a backside of the terminal 111 and the short plate 214 is bent by 90° so that the terminal 111 is insulated and secured within the sleeve 211, and then the resulting structure is cut and separated from the metal plate 11. Next, a housing 7 comprising an aperture and clamping plates located at a bottom thereof is provided. Next, the sleeve 211 together with the terminal 111 and the coaxial cable 31 electrically connected to the terminal 111 are disposed within the housing 7 such that the sleeve 211 is received inside the aperture and the coaxial cable 31 is disposed in between the clamping plates.

Figure 5:
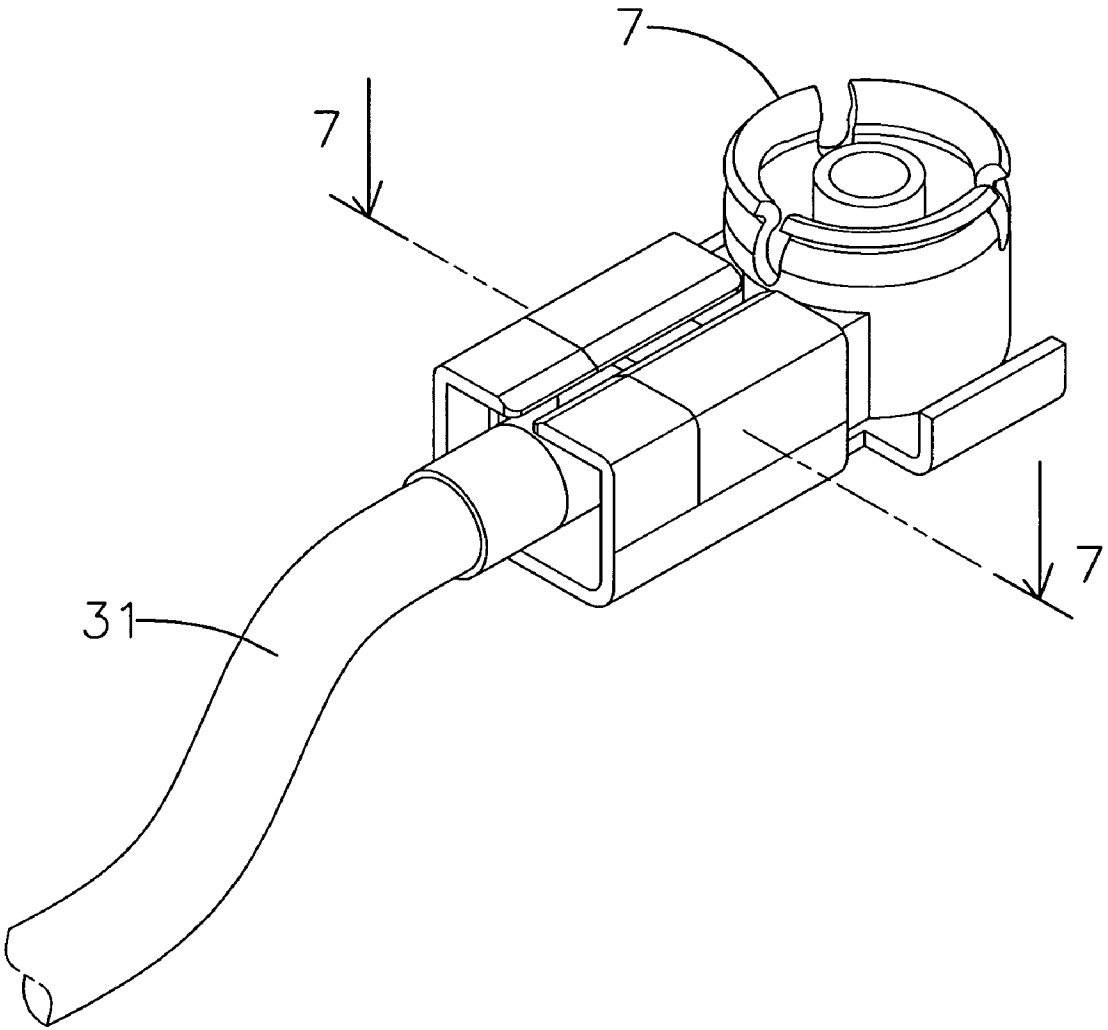
FIG. 5 shows a perspective view of an antenna connector after assembly thereof according to the method of the present invention.

Next, as shown in FIG. 5, the clamping plates are bent so as to secure the coaxial cable 31 and the sleeve 211 within the housing 7.

Figure 6:
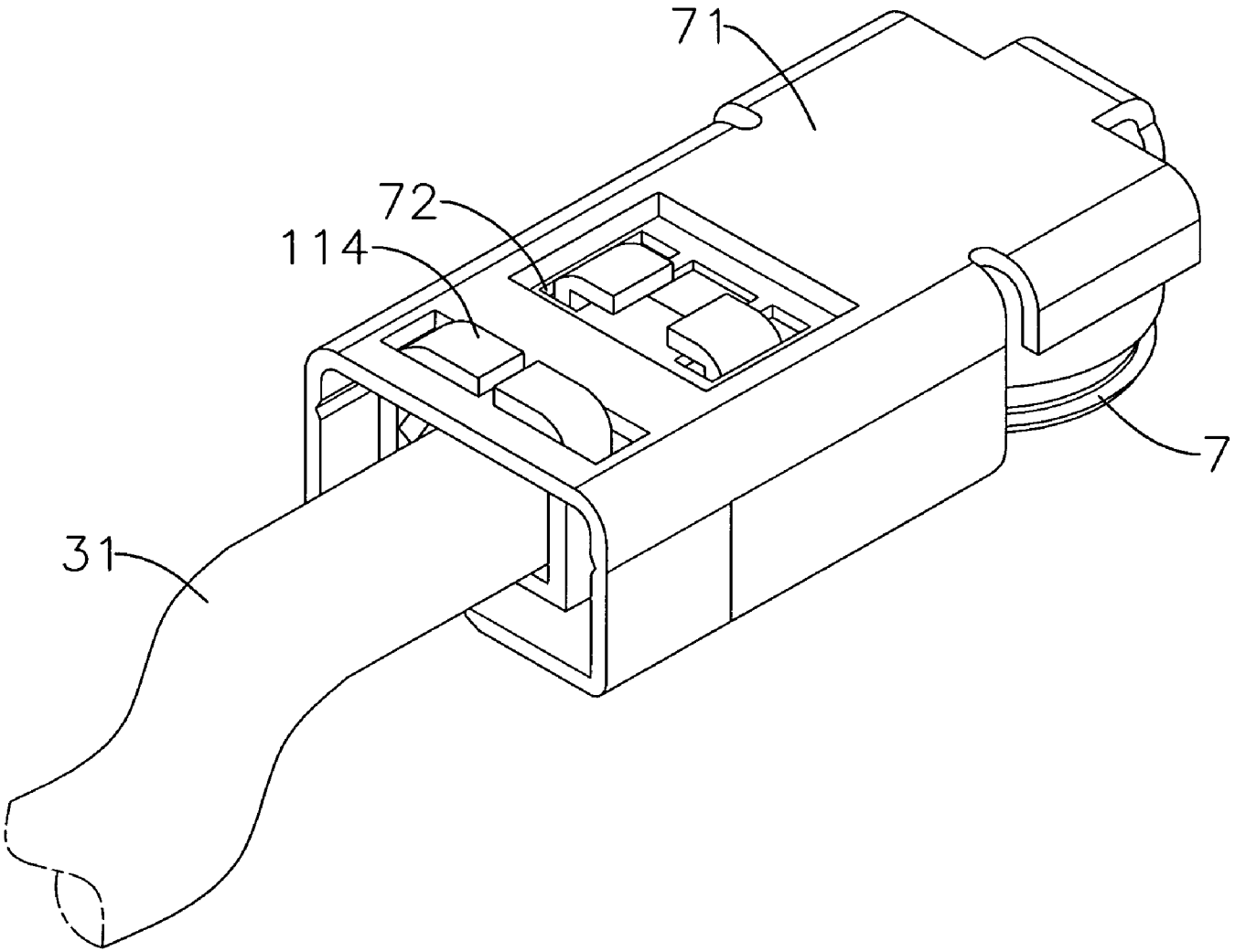
FIG. 6 shows a perspective back side view of an antenna connector after assembly thereof according to the method of the present invention.
Figure 7:
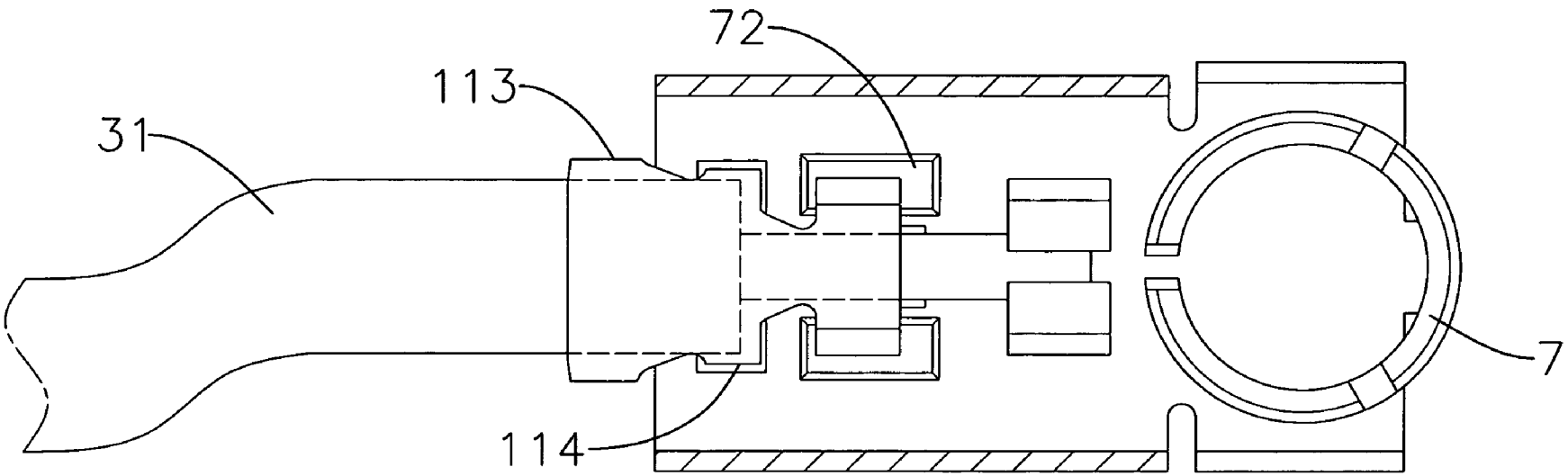
FIG. 7 shows a longitudinal cross sectional view taken along line 7-7 of FIG. 5.

Next, as shown in FIGS. 6 and 7, a back plate 71 comprising an aperture 72 corresponding to the buckling portion 114 of the clamping portion 113 is assembled to the above resulting structure such that the buckling portion 114 of the clamping portion 113 is buckled to the aperture of the back plate 71.

Hereinafter, the method of fabricating the antenna connector according to an embodiment of the present invention is described as follows.

At step 1, the metal plate 11 having the structure described above is provided and placed on an automatically operated workstation.

At step 2, the isolation member 21 is disposed over the metal plate 11 such that the sleeve 211 receives the terminal 111 and the fixing portions 212 connect with the wing boards 112.

At step 3, the coaxial cable 31 is clamped to the clamping portion 113 and electrically connected to the terminal 111.

At step 4, a cutting process is performed to separate the terminal 111 and the clamping portion 113, and the fixing portions from the metal plate 11 and the isolation member 21 respectively while the terminal 111 is positioned within the sleeve 211 of the isolation member.

At step 5, the long plate 213 is bent by 180° to cover a backside of the terminal 111 and the short plate 214 is bent by 90° so that the terminal 111 is insulated and secured within the sleeve 211.

At step 6, the sleeve 211 together with the terminal 111 and the coaxial cable 31 electrically connected to the terminal 111 into the housing 7 such that the sleeve 111 is received inside the aperture and the coaxial cable is disposed in between the clamping plates.

At step 7, the clamping plates are bent so as to secure the coaxial cable 31 and the sleeve 211 together with the terminal 111 within the housing 7.

At step 8, the back plate 71 described above is assembled to the metal plate 111 such that the buckling portion 114 is buckled to the aperture 72 of the back plate.

It should be noted that the components of the antenna connector mentioned above are mechanically assembled in an automatically operated workstation to effectively eliminate the labor/time consuming assembly process requiring assembly by hand as in the case of the prior art. The electrical connection between the coaxial cable 31 and the terminal 111 can be ensured and also the coaxial cable 31 can be effectively secured to the housing 7 so that the coaxial cable 31 may not come loose. Thus, it is not only possible to effectively increase the production throughput, but also the reliability of the antenna connector may be effectively promoted. Accordingly, a highly reliable antenna connector may be fabricated using the method of the present invention. The method according to the present invention described above makes the mass production of antenna connector with high reliability and reproducibility possible.

According to an aspect of the present invention, the terminal 111, the wing boards 112, the clamping portion 113 and the buckling portion 114 are integrally formed with the metal plate 11.

According to an aspect of the present invention, the sleeve 211, the fixing block 212, the long plate 213 and the short plate 214 are integrally formed with the isolation member 21.

According to an aspect of the present invention, wherein the housing 7 and the back plate 71 are comprised of a metallic material.

Although the invention has been explained in relation to its preferred embodiment, it is to be understood that many other possible modifications and variations can be made without departing from the spirit and scope of the invention as hereinafter claimed.

What is claimed is:

1. A method of fabricating an antenna connector suitable for processing on an automatically operated workstation, comprising the steps of:

providing and placing a metal plate on an automatically operated workstation, wherein the metal plate comprises a terminal, two wing boards disposed adjacent to and on either sides of the terminal and a wire clipper comprising a clamping portion disposed below the terminal, wherein the clamping portion comprises a buckling portion at a distal end thereof;

providing an isolation member comprising a sleeve corresponding to the terminal for receiving the terminal, two fixing portions corresponding to the two wing boards for connecting with the two wing boards, and a long plate and a short plate extending from a distal end side portion of the sleeve;

mechanically disposing the isolation member over the metal plate such that the sleeve receives the terminal and the fixing portions connect with the wing boards;

mechanically clamping an coaxial cable into the clamping portion and electrically connecting to the terminal;

mechanically cutting to separate the terminal and the clamping portion, and the fixing portions from the metal plate and the isolation member respectively while the terminal is positioned within the sleeve of the isolation member;

mechanically bending the long plate by 180° to cover a backside of the terminal and bending the short plate by 90° so that the terminal is insulated and secured within the sleeve;

mechanically providing a housing comprising an aperture and a clamping plates at a bottom thereof;

mechanically disposing the sleeve together with the terminal and the coaxial cable electrically connected to the terminal into the housing such that the sleeve is received inside the aperture and the coaxial cable is disposed in between the clamping plates;

mechanically bending the clamping plates so as to secure the coaxial cable and the sleeve together with the terminal within the housing;

providing a back plate comprising an aperture corresponding to the buckling portion of the metal plate; and mechanically clamping the bucking portion of the metal plate to the aperture of the back plate.

2. The method of fabricating an antenna connector according to claim 1, wherein the terminal, the wing board, the clamping portion and the buckling portion are integrally formed in the metal plate.

3. The method of fabricating an antenna connector according to claim 1, wherein the sleeve, the fixing block, the long plate and the short plate are integrally formed in the isolation member.

4. The method of fabricating an antenna connector according to claim 1, wherein the housing and the back plate are comprised of a metallic material.

* * * * *